US010480175B2

(12) United States Patent
Furlanetto

(10) Patent No.: US 10,480,175 B2
(45) Date of Patent: Nov. 19, 2019

(54) BUILDING

(71) Applicant: Guido Furlanetto, Codognè (IT)

(72) Inventor: Guido Furlanetto, Codognè (IT)

( * ) Notice: Subject to any disclaimer, the term of this patent is extended or adjusted under 35 U.S.C. 154(b) by 0 days.

(21) Appl. No.: 15/831,945

(22) Filed: Dec. 5, 2017

(65) Prior Publication Data

US 2018/0163390 A1 Jun. 14, 2018

(30) Foreign Application Priority Data

Dec. 12, 2016 (IT) ..... 102016000125286

(51) Int. Cl.

| | |
|---|---|
| ***E04B 1/34*** | (2006.01) |
| ***E04H 12/20*** | (2006.01) |
| ***E04B 1/18*** | (2006.01) |
| *E04B 1/00* | (2006.01) |

(52) U.S. Cl.

CPC ..... *E04B 1/3404* (2013.01); *E04B 1/185* (2013.01); *E04H 12/20* (2013.01); *E04B 2001/0053* (2013.01)

(58) Field of Classification Search

CPC ..... E04B 1/3404; E04B 1/185; E04B 2001/0053; E04H 12/20

See application file for complete search history.

(56) References Cited

U.S. PATENT DOCUMENTS

| | | | | |
|---|---|---|---|---|
| 3,388,512 | A * | 6/1968 | Newman | E04B 1/3404 52/125.2 |
| 3,395,502 | A * | 8/1968 | Frey | E04B 1/3404 52/73 |
| 5,377,465 | A * | 1/1995 | Kobori | E04B 1/3404 52/236.3 |
| 8,297,014 | B2 * | 10/2012 | Hanumantrao | E04H 1/04 52/236.4 |

FOREIGN PATENT DOCUMENTS

| | | | | |
|---|---|---|---|---|
| DE | 1230993 | B * | 12/1966 | E04H 1/04 |
| DE | 20 49 687 | B1 | 1/1972 | |
| DE | 2049687 | B1 * | 1/1972 | |
| DE | 3045177 | A1 * | 7/1982 | E04B 1/3404 |
| EP | 0 550 780 | A1 | 7/1993 | |
| EP | 0550780 | A1 * | 7/1993 | E04B 1/3404 |
| ES | 2 292 267 | A1 | 3/2008 | |
| GB | 2 365 886 | A | 2/2002 | |
| JP | 11-131827 | A | 5/1999 | |
| KR | 10-2011-0026725 | A | 3/2011 | |
| WO | WO-8404347 | A1 * | 11/1984 | E01F 3/00 |
| WO | 91/18161 | A1 | 11/1991 | |
| WO | WO-9530814 | A1 * | 11/1995 | E04B 1/3404 |

OTHER PUBLICATIONS

Remigio, "Tripod Skyscraper in Houston", eVolo | Architecture Magazine, Feb. 28, 2010 (Feb. 28, 2010), XP055400333, Retrieved from the Internet: URL:http://www.evolo.us/architecture/tripod-skyscraper-in-houston/ [retrieved on Aug. 22, 2017].

* cited by examiner

*Primary Examiner* — Adriana Figueroa

(74) *Attorney, Agent, or Firm* — Vorys, Sater, Seymour and Pease LLP

(57) ABSTRACT

A building is provided, which includes a plurality of towers including a central tower and a plurality of peripheral towers, a plurality of connections and at least one intermediate body including a surface extension sufficient to contain at least one or more floors of the central tower and the floors of the peripheral towers at the same height.

9 Claims, 2 Drawing Sheets

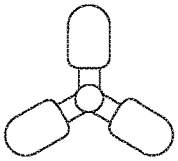
*Fig. 3c (F-F)*
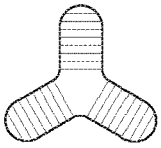
*Fig. 5b (H-H)*
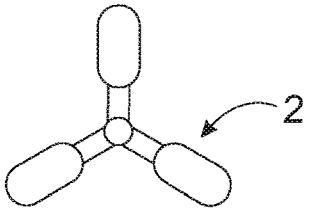
*Fig. 3b (C-C)*
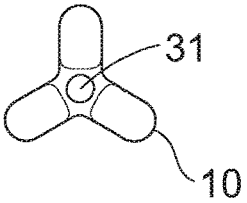
*Fig. 5a (G-G)*
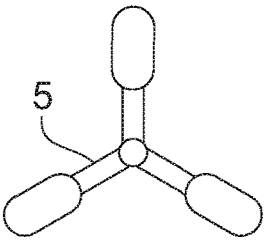
*Fig. 3a (B-B)*
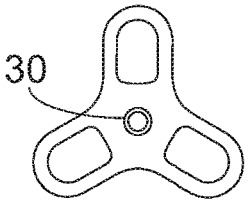
*Fig. 4b (E-E)*
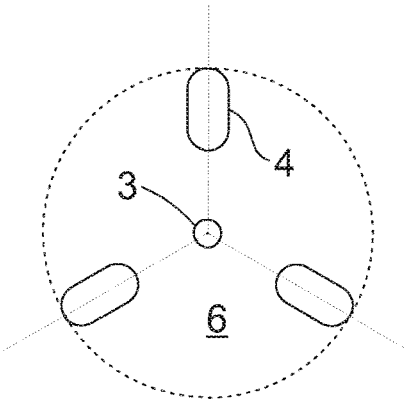
*Fig. 2 (A-A)*
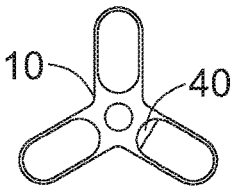
*Fig. 4a (D-D)*

BUILDING

FIELD OF THE INVENTION

The present invention relates to a building of the type comprising a plurality of towers including a central tower and a plurality of peripheral towers, a plurality of connections, and at least one intermediate body including a surface extension sufficient to contain at least one or more floors of the central tower and the floors of the peripheral towers at the same height.

DESCRIPTION OF THE PRIOR ART

In particular, the invention relates to a building in which a characteristic dimension is greater than the others, in particular a skyscraper.

Skyscrapers are known in the current state of the art. They are large buildings, expanded upwards, generally comprising a plurality of habitable floors.

In structural terms, a skyscraper substantially has a very resistant steel core around which an elastic frame is developed, which allows slight flexing in the case of catastrophic events, such as earthquakes or the like which tend to make the entire structure sway.

There are currently less than twenty buildings in the world that can be defined as skyscrapers, without considering the World Trade Center Twin Towers sadly known for the events of Sep. 11, 2001.

Among them only ten buildings exceed 400 meters in height.

In addition, these giants draw inspiration from various types of models: the bell tower model, the ziggurat model, and the plaza model.

In the bell tower model the front of the tower only rises in the central part of the building's core. Hence, the term "bell tower" since all buildings of this type have a thin, yet high tower emerging from the central body of the building just like a bell tower.

The most famous example of this type of building is represented by the Woolworth Building.

In the ziggurat model the building can be extended in height theoretically to infinity, but with a gradual moving back of the front that culminates at the apex of the construction. Hence the term that refers to the ancient Mesopotamia pyramids and gives the most modern man-made constructions a certain fascination of antiquity.

It is no coincidence that one of the examples of this type of construction is the Rockefeller Center, also nicknamed New Babylon.

The plaza model represents the most technological and complex solution to the problem of raising buildings in the modern city. Based on this model the building is directly conceived in the exact centre of the plot of land in which almost all the area remains free and constitutes a real square beneath the entire perimeter of the building, hence the Spanish name.

This system not only creates in the collective imagination the tower with the classical shape of a regular parallelepiped.

Examples thereof are the already mentioned Twin Towers, as well as the Sears Tower in Chicago.

Among the first five skyscrapers, the Burj Khalifa, the Shanghai Tower, the Abraj Al-Bait Towers, the One World Trade Center and the Taipei 101 are also known.

The Burj Khalifa has a substantially ziggurat-like structure, while the other structures are inspired by plaza models with variations that are different from project to project.

For example, the Shanghai Tower has a plan section which rotates along the entire height of the building, while the Taipei 101 has a "bamboo" shape, i.e. with planes diverging upwardly and extending one above the other.

The described prior art has a few major drawbacks.

In particular, especially for complexes such as the Twin Towers, the Petronas Twin Towers or the Abraj Al-Bait Towers, the skyscrapers have enormous lighting issues.

In particular, natural lighting is strongly inhibited both in the areas adjacent to the base of the buildings themselves and in the central areas of the building itself, i.e. towards the steel core.

Moreover, another drawback is the difficulty in implementing thermal conditioning throughout the building, which requires the construction of plants and wiring inside the building, resulting in a reduction of the available space that is already reduced per se due to the presence of the central core of the skyscraper.

Lastly, another drawback is the difficulty in ventilating the floors in the building considering that, especially for plaza structures, the floors have large surface extensions.

Another example of a building similar to the building according to the invention is described in eVolo edited Architecture Magazine, 28 Feb. 2010 (2010 Feb. 28), XP055400333, written by Alex C. Remigio and titled "Tripod Skyscraper in Houston" (also URL:http://www.evolo.us/architecture/tripod-skyscraper-in-houston/[accessible on 2017 Aug. 22]). However this kind of building needs a too large base if it is very high.

SUMMARY OF THE INVENTION

In this context, the technical task underlying the present invention is to devise a building, which is capable of substantially obviating at least some of the above-mentioned drawbacks.

Within the scope of said technical task, a major object of the invention is to obtain a building which enables a greater structural yield, resulting in the possibility of increasing the height of the building, together with a greater implementation simplicity compared to what is already known.

Within the scope of said technical task, a further major object of the invention is to obtain a building which allows better lighting of the surrounding environment and the environments therein.

Another important object of the invention is to provide a building that allows thermal conditioning of its living spaces without sacrificing internal volumes, otherwise used for habitation, with extensive plants or wiring.

In conclusion, a further object of the invention is to provide a building that facilitates ventilation of the floors therein.

The technical task and the specified objects are achieved by a building comprising: a plurality of towers including a central tower and a plurality of peripheral towers, a plurality of connections, and at least one intermediate body including a surface extension sufficient to contain at least one or more floors of the central tower and the floors of the peripheral towers at the same height, the central tower being structurally connected to the peripheral towers by means of at least one of the connections and extends over the entire height of the building, the peripheral towers being separated from each other, arranged around the central tower, thereby defining a plurality of trestle-like structures, the trestle-like structures overlapping along the height of the building and separated by the intermediate bodies.

BRIEF DESCRIPTION OF THE DRAWINGS

The features and advantages of the invention will be apparent from the detailed description of preferred embodiments of the invention, with reference to the accompanying drawings, in which:

FIG. 2 shows a plan view of the base of the building;

FIG. 3*a* is a plan view of the first connection between the towers;

FIG. 3*b* is a plan view of the second connection between the towers;

FIG. 3*c* is a plan view of the third connection between the towers;

FIG. 4*a* is a plan view of the lower base of the first intermediate body;

FIG. 4*b* is a plan view of the upper base of the first intermediate body;

FIG. 5*a* is a plan view of the lower base of the second intermediate body;

FIG. 5*b* is a plan view of the upper base of the second intermediate body.

DESCRIPTION OF THE PREFERRED EMBODIMENTS

Figure 1:
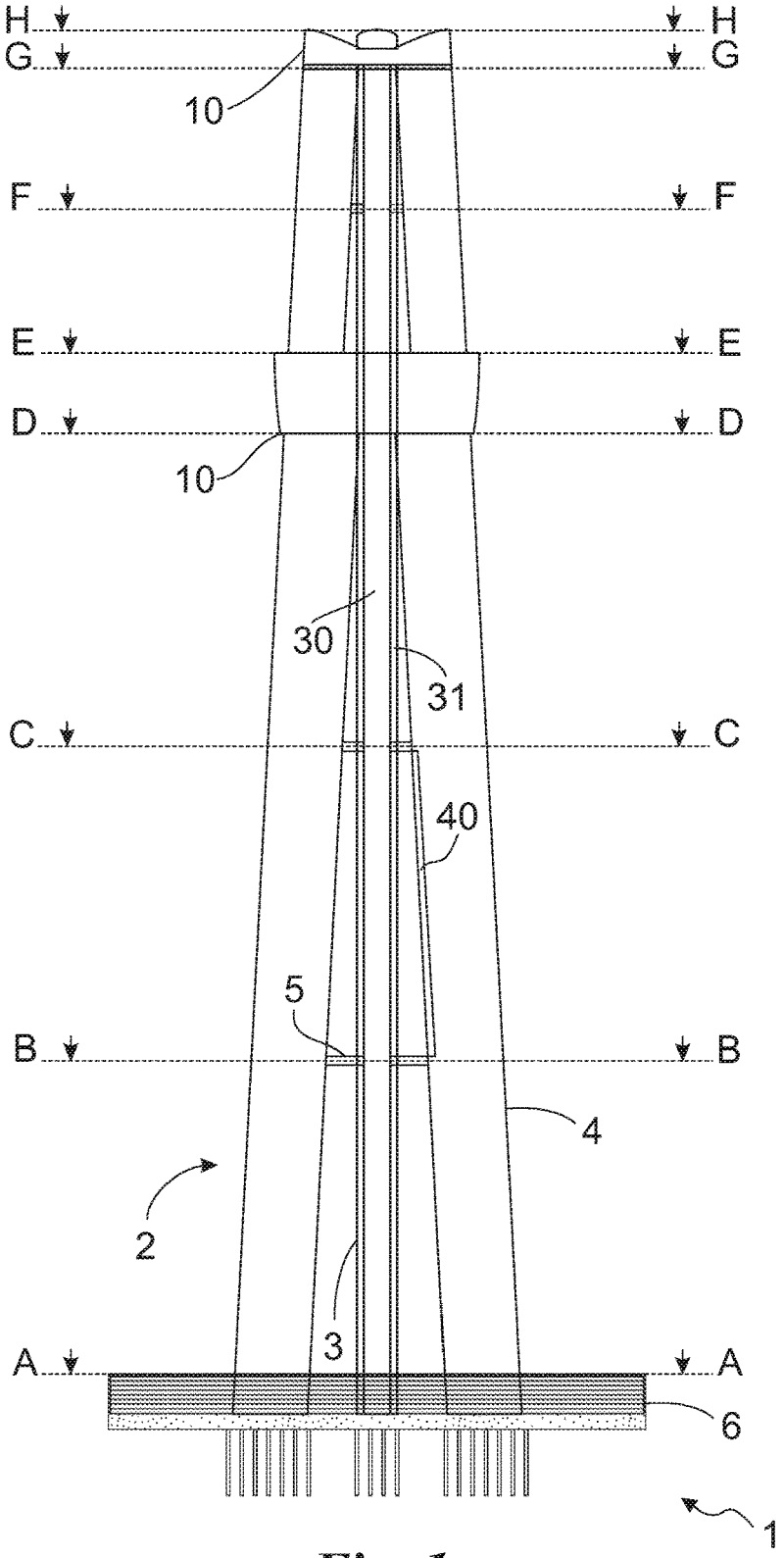
FIG. 1 shows a front view of the building according to the invention.

In the present document, the measures, values, shapes and geometric references (such as perpendicularity and parallelism), when associated with terms like "about" or other similar terms such as "almost" or "substantially", are to be understood as unless measurement errors or inaccuracies due to production and/or manufacturing defects and, especially, unless a slight difference from the value, the measure, the shape, or the geometric reference with which it is associated. For example, these terms, if associated with a value, preferably indicate a difference not exceeding 10% of the value itself.

Furthermore, when used, terms such as "first", "second", "higher", "lower", "main" and "secondary" do not necessarily identify an order, a priority relationship or a relative position, but can simply be used to distinguish more clearly the different components from each other.

With reference to the Figures, the building according to the invention is indicated as a whole by the numeral 1.

The building 1 is a building mainly extending in height and therefore is preferably substantially a skyscraper. However, the structure represented by the building itself could also be used for smaller buildings.

The building 1 preferably comprises a plurality of towers 2 and a plurality of connections 5.

The term tower 2 is intended to mean a building or a portion of a building characterized in that its greatest dimension is its height, which is significantly larger than those of the base.

In particular, the towers 2 comprise a central tower 3 and a plurality of peripheral towers 4.

Preferably, the towers 4 are arranged around the central tower 3 so as to be equally spaced at the base with respect to the central tower 3 itself.

However, alternative configurations may involve peripheral towers 4 differently spaced from the central tower 3.

Preferably, the towers 4 are three in number and are particularly arranged radially with respect to the central tower 3 and spaced from one another by an angle equal to 120°.

Also preferably, the central tower 3 is structurally connected to the peripheral towers 4, and more suitably to each peripheral tower 4.

Moreover, the peripheral towers 4 are preferably separate from each other. By being separate, for example, they never adhere along their lateral surface.

However, said peripheral towers 4 could be connected to each other.

The connection between the towers 2, and in particular between the central tower 3 and the peripheral towers 4, is provided, for example, by means of at least one of the connections 5.

Thus, the connections 5 are preferably tunnels, the sizes of which are at least such as to allow the passage therein of people and/or plants intended for the building 1.

Therefore, these tunnels can be arranged parallel to the ground or inclined with respect to the same, provided that they allow a correct and operative connection between the towers 2.

Preferably, the peripheral towers 4 are arranged around the central tower 3 substantially in a trestle-like structure.

This configuration means that the peripheral towers 4 are inclined, in height, towards the central tower 3, while the central tower 3 is substantially straight. The peripheral towers 4 thus converge from the base to the top, where they are substantially united.

Also preferably, the peripheral towers 4 maintain the same size, in plan, or in the horizontal section, for each floor.

Therefore, the peripheral towers 4 converge, extending in height, towards the central tower 3 while maintaining the same plan surface for each floor.

Especially by virtue of the above structural configuration, the connections 5 are therefore, for example, bracing channels between the central tower 3 and the peripheral towers 4.

Therefore, these bracing channels not only serve the function of putting the various towers into communication, but also, from a structural point of view, the function performed by, for example, the typical braces of aeronautical structures, especially of small aeroplanes.

As said, the peripheral towers 4 are preferably separate from each other. Preferably, however, the building 1 comprises at least one intermediate body 10 that brings together in a single element all the towers 2, or more appropriately the floors of the towers 2 at the same height.

Thus, such intermediate body 10, in particular, includes a surface extension sufficient to contain at least one or more floors of the central tower 3 and the floors of the peripheral towers 4 at the same height.

Furthermore, the intermediate body 10 can thus consist of a single floor or a single balcony, or of a complex of floors comprising all the towers 2 in its interior.

Preferably, the building 1 comprises a plurality of intermediate bodies 10. These intermediate bodies 10 are designed to be substantially overtopped by the central tower 3, while each constitutes the top of the peripheral towers 4.

Therefore, the building 1 preferably consists of a single central tower 3 extending throughout the height of the building 1, and at least one, appropriately a plurality of, peripheral tower(s) 4 starting from each intermediate plane 10.

Therefore, unless the intermediate plane 10 is located on the top of the whole building, it constitutes the base for the peripheral towers 4 at different heights.

In particular, the building 1 preferably has two intermediate bodies 10, and in particular two. Preferably, the building 1 comprises one intermediate body 10 at approximately half the overall height of the building 1 and one on its top.

The intermediate body 10 located on the top of the building 1 comprises, for example, a runway for aircraft.

Also preferably, the peripheral towers 4 are inhabitable, while the central tower 3 is not.

In fact, preferably, the central tower 3 comprises means of transport 30 and power supply means 31.

The means of transport 30 are thus lifts or hoists and the power supply means 31 are plants for the ventilation and conditioning of the peripheral towers 4.

The power supply means 31 may comprise wiring, motors, pipes, tunnels and the like for the supply of the whole building 1.

As regards the peripheral towers 4, they can be used for housing offices or home accommodations and much more that can be hosted on any floor of a building.

Since, preferably, there are three connections 5 between each peripheral tower 4 and the central tower 3, the peripheral towers 4 may also comprise internal means of transport 40 such as, for example, lifts.

For example, internal means of transport 40 may preferably be provided between each connection 5 communicating with the same peripheral tower 4.

Lastly, the building 1 preferably comprises a base 6.

Such a base 6 is arranged, for example, beneath the central tower 3 and the peripheral towers 4.

Also, the base 6 preferably comprises an extension surface adapted to at least contain the plan sections at the same height of the towers 2 and therefore of the central tower 3 and the peripheral towers 4.

Preferably, as previously anticipated, each intermediate body 10 not located on the top has the same characteristics of the base 6 for the peripheral towers 4 arranged starting from the top of the same intermediate planes 10.

The central tower 3, on the other hand, acts as a through body extending over the entire height of the building regardless of whether or not there is an intermediate body 10.

In the preferred configuration, in fact, the building comprises a single central tower 3 and six peripheral towers 4 extending at the same height in groups of three.

Therefore, the structure of the building defines an overlapping double trestle-like structure comprising a single central tower 3.

By increasing the number of intermediate bodies 10, there may be an increase in the number of trestle-like structures, each comprising a plurality of peripheral towers 4 overlapping in height and separated by the intermediate bodies 10.

In particular, the base 6 preferably comprises a plurality of floors defining a car park.

From a dimensional and/or constructive point of view, for example, the building 1 has an overall height that can reach 1 km.

In addition, the towers 2 preferably rise by 7 hm up to a first intermediate body 10.

In turn, the first intermediate body 10 extends in height for 6 dam.

After passing the first intermediate body 10, the towers extend in height, separately for another 2.1 hm, until reaching a second intermediate body 10 in turn extending in height for 3 dam.

In addition, the base 6 preferably extends beneath the towers 2 for 3 dam.

The base 6 comprising the towers 2 can therefore consist of, for example, a body having a circumferential section and a radius of 1.2 hm.

Furthermore, the peripheral towers 4 can be, for example, equally spaced from the central tower 3 by 6 dam.

In particular, the peripheral towers 4 are preferably arranged so that, when there is no intermediate body 10, they never oppose a strong solid surface with respect to the wind direction.

Lastly, the central tower 3 can also have a circular section with a radius equal to 1 dam and is preferably made of high-strength concrete (or HSC) i.e. having minimum resistance values at least equal to 60 $N/mm^2$.

As regards the connections 5, they may be tunnels with a square section and sides equal to 1.5 dam, or with a circular section and a diameter equal to 1.5 dam.

The building 1 according to the invention achieves important advantages.

In fact, the building 1, owing to its conformation, allows for obtaining open spaces, which enable better global lighting not only of the adjacent areas, but also of the internal floors.

In fact, the trestle-like structure allows for using peripheral towers 4 free of the heavy central steel core typical of the conventional structures, and to reduce the characteristic size so as to maintain the improved light penetration.

Furthermore, the trestle-like structure, characterized by the towers 2, is structurally more resistant than a single tower structure.

The overlapping trestle-like structures, in particular, allow the building's height to be extended without encountering structural problems. In fact, the peripheral towers, which are more subject to flexural loads, can be structured with lower heights than the central tower. In addition, the fact that there is only one central tower that extends throughout the height, with trestle-like structures at multiple levels around it, allows the elevation of the central tower itself and the provision of all connections (referring to services such as power supply, etc.) of the building and contained in the central tower to be conducted with greater ease in the construction phase.

These aspects are further evidenced by the fact that the spaces between the separate peripheral towers 4 allow the wind to meet with less opposition by the strong structural surfaces, and therefore the structure of the building 1 is subjected to a lesser strength than, for example, a canonical plaza skyscraper.

In addition, the connections 5 ensure a good structural strength, even in the case of catastrophic situations, together with the peripheral towers 4 that converge on the central tower 3 by resting thereon.

A further advantage of the building 1 according to the invention is that the small size of the individual peripheral towers 4 allow a better and simplified control of the thermal conditioning and ventilation compared to conventional structures.

This aspect is further enhanced by the fact that most transport and power supply systems are located in the central tower 3 far from the housing compartments.

The invention is susceptible of variations falling within the scope of the inventive concept as defined by the claims.

For example, it is possible to vary the plan shape of the towers 2 or the inclination of the peripheral towers 4, which may be inclined along a straight line or inclined along a bending direction.

In this context, all the details are replaceable by equivalent elements and the materials, shapes and dimensions may be any materials, shapes and dimensions.

The invention claimed is:

1. A building comprising:

a plurality of towers including a central tower and a plurality of peripheral towers, a plurality of connections, and at least one intermediate body including a surface extension sufficient to contain at least one or more floors of said central tower and the floors of said peripheral towers at the same height, said central tower being structurally connected to said peripheral towers by means of at least one of said connections and extends over the entire height of said building, said peripheral towers being separated from each other, arranged around said central tower, thereby defining a plurality of trestle structures, said trestle structures overlapping so that one of the trestle structures is above the other trestle structures, said peripheral towers converging, extending in height, towards said central tower while maintaining the same plan surface for each floor, said connections being substantially bracing channels between said central tower and said peripheral towers, the central tower extending for the whole height of said building, the peripheral towers forming, with the central tower, the plurality of trestle structures overlapping on opposing sides of the at least one intermediate body.

2. The building according to claim 1, wherein said at least one intermediate body comprises at least two intermediate bodies having an upper intermediate body located on the top of said building and comprising a runway for aircraft.

3. The building according to claim 1, wherein said central tower is not inhabitable and said peripheral towers are inhabitable.

4. The building according to claim 1, wherein said central tower comprises means of transport and power supply means, said means of transport being lifts and said power supply means being plants for the ventilation and conditioning of the peripheral towers.

5. The building according to claim 1, comprising a base arranged beneath said central tower and said peripheral towers, said base comprising an extension surface adapted to at least contain the plan sections at the same height of said central tower and said peripheral towers.

6. The building according to claim 1, wherein said base comprises a plurality of floors defining a car park.

7. The building according to claim 1, wherein said at least one intermediate body comprises at least two intermediate bodies having an upper intermediate body located on the top of said building and comprising a runway for aircraft, wherein said central tower is not inhabitable and said peripheral towers are inhabitable, wherein said central tower comprises means of transport and power supply means, said means of transport being lifts and said power supply means being plants for the ventilation and conditioning of the peripheral towers, comprising a base arranged beneath said central tower and said peripheral towers, said base comprising an extension surface adapted to at least contain the plan sections at the same height of said central tower and said peripheral towers, wherein said base comprises a plurality of floors defining a car park.

8. The building according to claim 5, wherein the peripheral towers are arranged around the central tower to be equally spaced at the base with respect to the central tower itself.

9. The building according to claim 1, the connections between the central tower and the peripheral towers being tunnels to allow the passage therein of people and/or plants intended for the building.

* * * * *